United States Patent [19]

Hughes

[11] Patent Number: 4,730,980

[45] Date of Patent: Mar. 15, 1988

[54] AIR SUPPLY SYSTEM

[76] Inventor: George W. Hughes, 2178 N. Orange Grove, Pomona, Calif. 91767

[21] Appl. No.: 758,059

[22] Filed: Jul. 23, 1985

[51] Int. Cl.[4] ..... F04D 29/00

[52] U.S. Cl. ..... 415/143; 55/409; 415/168; 415/DIG. 8

[58] Field of Search ..... 55/261, 409, 306; 415/143, 168, DIG. 8

[56] References Cited

U.S. PATENT DOCUMENTS

| | | | |
|---|---|---|---|
| 2,554,002 | 5/1951 | Sutton . | |
| 3,106,261 | 10/1963 | Mackie . | |
| 3,127,863 | 4/1964 | Tinajero | 114/16 |
| 3,173,509 | 3/1965 | Wernicke et al. . | |
| 3,219,135 | 11/1965 | Bunting et al. | 180/7 |
| 3,233,693 | 2/1966 | Havercamp | 180/7 |
| 3,236,045 | 2/1966 | Berger et al. | 60/311 |
| 3,244,246 | 4/1966 | Weiland | 180/7 |
| 3,268,022 | 8/1966 | Gustafson | 180/7 |
| 3,280,930 | 10/1966 | Leggett | 180/7 |
| 3,313,366 | 4/1967 | Dionisio | 180/7 |
| 3,336,995 | 8/1967 | Farb et al. | 180/7 |
| 3,650,633 | 3/1972 | Benoit | 415/143 |
| 3,667,567 | 6/1972 | Rutkowski | 180/117 |
| 3,777,842 | 12/1973 | Laufman | 180/117 |
| 3,811,527 | 5/1974 | Pont et al. | 180/121 |
| 3,869,020 | 3/1975 | Holland | 180/120 |
| 4,213,736 | 7/1980 | Gongwer | 415/182 |
| 4,269,567 | 5/1981 | Phillips et al. | 55/409 X |
| 4,568,256 | 2/1986 | Blain | 55/409 X |
| 4,600,413 | 7/1986 | Sugden | 55/409 X |

FOREIGN PATENT DOCUMENTS

| | | | |
|---|---|---|---|
| 120534 | 11/1945 | Australia | 415/143 |
| 649352 | 1/1951 | United Kingdom | 55/409 |

OTHER PUBLICATIONS

Aerodyne Development literature, Form No. 9167R1, Aerodyne Development Corporation, 5080 Warrensville Center Road, Maple Heights, Ohio 44137.

Budinsky, Karel, "Rotating Centrifugal Separator with Continuous Dust Removal", Staub-Reinhart, Luft vol. 30, No. 9, Sep. 1970.

*Primary Examiner*—Harold Joyce

*Attorney, Agent, or Firm*—Finnegan, Henderson, Farabow, Garrett & Dunner

[57] ABSTRACT

An air supply system includes an air accelerating chamber formed by truncated conical intake and exhaust ducts joined at the truncated ends to be coaxial. The system also includes a fan impeller having a hollow cylindrical hub with impeller blades on the outer periphery and is rotatably mounted in the exhaust duct to provide a first accelerated air stream passing between the exhaust duct and hub, and a second accelerated air stream passing through the hub. Pressurized gas, such as combustion gases from an internal combustion fan drive, can be admitted to the intake duct to produce swirl, and additional impeller blades can be provided in the interior of the hub to further accelerate the second air stream.

9 Claims, 1 Drawing Figure

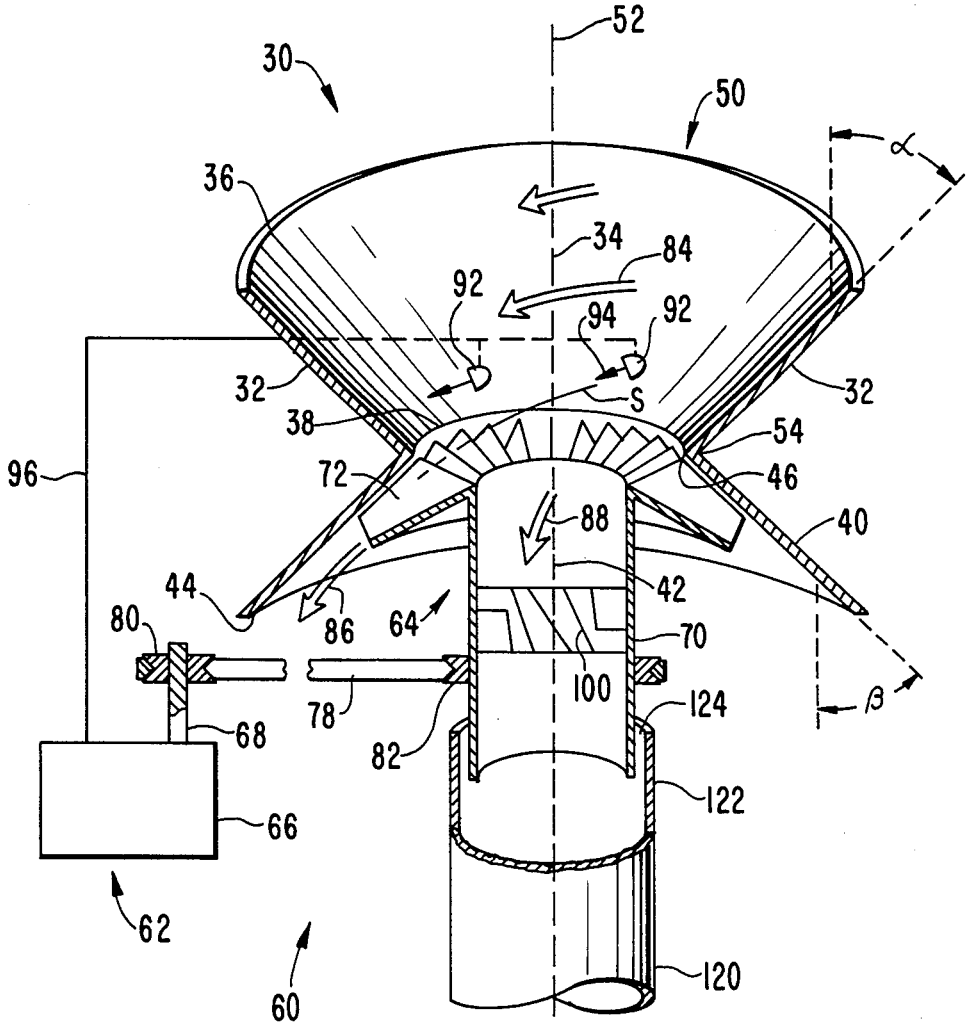
52
30
50
α
36
34
84
92
94
92
32
S
32
38
54
96
72
46
88
40
44
42
80
86
64
70
100
124
β
78
68
82
122
66
62
120
60

AIR SUPPLY SYSTEM

BACKGROUND OF THE INVENTION

This invention relates to air supply systems of the type using a rotating impeller positioned in an air supply duct.

SUMMARY OF THE INVENTION

In accordance with the present invention as embodied and broadly described herein, the air supply system comprises an air acceleration chamber, the chamber formed from a hollow, open-ended intake duct in the shape of a truncated cone, and a hollow, open-ended exhaust duct in the shape of a second truncated cone. The intake and exahust ducts are coaxially aligned along a chamber axis and are joined at their respective truncated conical ends to form a minimum flow area throat. The system further comprises fan means for generating first and second accelerated air streams in the air acceleration chamber, the fan means including fan drive means and a fan impeller mounted in the exhaust duct for rotation about the exhaust duct axis, the fan impeller being operatively connected to be rotatingly driven by the fan drive means. The impeller has a hollow, open-ended hub and a first set of blades mounted on the outer periphery of the hub, the first accelerated air stream flowing between the outer periphery of the hub and the exhaust duct, and the second accelerated air stream flowing through the interior of the hub.

Preferably, the air supply system further includes means for inducing swirl in the air flowing through the intake duct, wherein the swirl inducing means includes a source of high pressure gas and at least one nozzle positioned about the periphery of the intake duct. The nozzle is connected to a high pressure gas source which preferably is the fan drive means if an internal combustion engine is used, and oriented to admit the high pressure gas tangentially into the intake duct.

It is also preferred that the air supply system fan means includes a second set of impeller blades mounted on the inner periphery of the hollow impeller hub for further increasing the velocity of the second accelerated air stream.

The accompanying drawing which is incorporated in, and constitutes a part of, this specification, illustrates one embodiment of the invention and, together with the description, serves to explain the principles of the invention.

BRIEF DESCRIPTION OF THE DRAWING

The FIGURE is a schematic view of an air supply system constructed in accordance with the present invention.

DESCRIPTION OF THE PREFERRED EMBODIMENT

Reference will now be made in detail to the present preferred embodiment of the invention, an example of which is illustrated in the accompanying drawing.

In accordance with the present invention, the air supply system includes an air acceleration chamber formed in part by a hollow, open-ended intake duct in the shape of a truncated cone. As embodied herein, air supply system 30 includes intake duct 32 which has the shape of a right-circular cone with conical angle $\alpha$ and a cone axis 34. Intake duct 32 has open base end 36 for admitting air to be accelerated and open truncated end 38.

Further in accordance with the present invention, the air accelerating chamber is also formed in part by a hollow, open-ended exhaust duct in the shape of a second truncated cone. As embodied herein, air supply system 30 includes exhaust duct 40 in the shape of a right-circular cone having an angle $\beta$ with conical axis 42. Exhaust duct 40 has an open base end 44 and an open truncated end 46. As shown in the FIGURE, intake duct 32 and exhaust duct 40 are joined at their respective truncated ends 38 and 46 so that the respective conical axes 34 and 42 are in colinear relation, the joined intake and exhaust ducts thus forming overall air acceleration chamber 50 having chamber axis 52 and minimum flow area throat section 54 formed by the joined truncated ends 38 and 46.

Further in accordance with the present invention, the air supply systems also includes fan means for generating first and second accelerated air streams in the air acceleration chamber. Specifically, the fan means includes a fan drive means and also includes a fan impeller mounted in the exhaust duct portion of the air acceleration chamber. As embodied herein and with continued reference to the FIGURE, fan means designated generally by the numeral 60 includes fan drive means 62 and fan impeller 64. Fan drive means 62 includes a power source (shown schematically as 66) with a rotating power takeoff shaft 68. Power source 66 preferably is an internal combustion engine, but an electric or gas turbine power source could be used. However, the latter alternatives would be expected to increase the cost and/or weight of the air supply system.

Fan impeller 64 includes hollow, cylindrical hub portion 70 and a set of impeller blades 72 mounted on the outer periphery of hub 70. Hub 70 is mounted in exhaust duct 40 for rotation about chamber axis 52. Struts (not shown) extending from the walls of exhaust duct 40 with anti-friction bearings (also not shown), can be used to mount hub 70. Other mounting means and configurations are, of course, possible and are considered within the scope of this invention. Power takeoff shaft 68 is operatively connected to hub 70 by friction belt 78 passing around sheaves 80 and 82. Again, other means for connecting power takeoff shaft 68 and hub 70, such as a direct geared interconnection, are possible and are considered within the scope of the present invention.

Impeller blades 72 are mounted proximate the chamber throat region 54 and are configured to provide a close running clearance with the walls of duct 40. The suction provided by the rotation of blades 72 induces an air flow (depicted by double arrows 84) through intake duct 32. Air flow 84, which has both axial and tangential velocity components is accelerated as it approaches throat 54 as a consequence of Bernoulli's principle and the law of conservation of angular momentum. After the air flow passes through throat 54 it is split into two accelerated air streams, a first stream (double arrow 86) passing between the wall of exhaust duct 40 and the outer periphery of hub 70, and a second, separate air stream 88 passing through the hollow cylindrical hub 70. The first accelerated air stream 86 is then acted on directly by blades 72 to provide further acceleration.

It is presently preferred that the cone angles $\alpha$ and $\beta$ of intake duct 32 and exhaust duct 40, respectively, are chosen such that extensions of streamlines (see e.g.

stream line "S" in the FIGURE) drawn along the wall of intake duct 32 would pass through throat 54 without bending, and would lie along the wall of exhaust duct 40. The resulting substantially straight streamlines will have the effect of minimizing the tendency for flow separation and turbulence downstream of the throat. This preferred construction can be achieved using right circular conical ducts and having equal conical angles $\alpha$, $\beta$.

Preferably, the air supply means includes means for inducing swirl in the air flowing through the conical intake duct. As embodied herein, the swirl inducinq means includes a series of nozzles 92 (only 2 nozzles being shown) positioned on the wall of intake duct 32 and directed to admit high pressure gas tangentially in the intended swirl direction (designated by single arrows 94). The tangentially admitted high pressure gas causes the air flow in intake duct 32 to have a higher tangential velocity component than a construction without high pressure gas injection. In the case where an internal combustion engine or other source of high pressure combustion gas is used for fan drive means 62, as is shown in the FIGURE, it is preferred that the fan drive means also comprise the source of the pressurized gas used to induce swirl in the intake duct. One skilled in the art would know how to operatively connect the engine exhaust to the nozzles 92 such as by using pipe 96.

Swirl action induced along the flow path through chamber 50 will follow the decrease in flow area with faster swirl velocity inducing faster axial velocity. Swirl motion will stay against the wall of inlet duct 32 with increased tangential velocity until the flow crosses throat area 54 where the flow will straighten and rotate slower as the area increases in exhaust duct 40. An additional benefit to the swirl is the centrifugal separation of dust and dirt from the air destined to form the second accelerated air stream passing through hub 70. Also, using relatively warm combustion gases for the injected high pressure gas, the warmer air will cling to the colder wall surfaces including the wall surface of exhaust duct 40. This clinging warm air/gas layer allows an increased wall-blade tip clearance. In an alternative construction (not shown) hot exhaust gases may be injected into hub 70 to add heat and momentum to the second accelerated air stream.

It is also preferred that the air supply system include a second set of impeller blades positioned within the hollow hub to further accelerate the second accelerated air stream. As embodied herein, fan impeller 64 includes a set of blades 100 mounted about the inner periphery of hollow, cylindrical hub 70 to act directly on second accelerated air stream 88. Second blade set 100 may be useful in applications where, during startup, no preexisting air flow exists in intake duct 32, in order to preclude reverse flow in hub 70. It should be made clear, however, that in the case wherein no second set of impeller blades is positioned within the hollow impeller hub, a second accelerated air stream can be maintained as a result of the momentum of the air flowing in intake duct 32. In the embodiment depicted in the FIGURE, this second accelerated air stream is further accelerated by the direct action of impeller blades 100.

It is still further preferred that the air supply system include means for channeling the second accelerated air stream away from the hollow, rotating hub. As is embodied herein, and with continued reference to the FIGURE, tubular duct 120 including duct end 122 is provided for receiving the second accelerated air stream from hub 70. Duct end 122 is sized to provide a running clearance 124 between rotating hub 70 and the stationary duct 120.

As will be apparent to those skilled in the art, various modifications and variations can be made in the air supply system of the present invention without departing from the scope and the spirit of the invention. It is intended that the present invention cover the modifications and variations of this invention provided they come within the scope of the appended claims and their equivalents.

What is claimed is:

1. An air supply system comprising:

an air acceleration chamber, said chamber including (i) a hollow, open-ended intake duct in the shape of a truncated cone, and (ii) a hollow, open-ended exhaust duct in the shape of a second truncated cone, wherein said intake and exhaust ducts are coaxially aligned along a chamber axis and are joined at their respective truncated conical ends to form a minimum flow area throat edge;

fan means for generating first and second accelerated air streams in said air acceleration chamber, said fan means including (i) fan drive means, (ii) a fan impeller mounted in said exhaust duct for rotation about the exhaust duct axis, said fan impeller being operatively connected to be rotatingly driven by said fan drive means, said impeller having a hollow, open-ended hub and a first set of blades mounted on the outer periphery of said hub, said first accelerated air stream flowing between the outer periphery of said hub and said exhaust duct, and said second accelerated air stream flowing through the interior of said hub.

2. The air supply system as in claim 1 wherein means are provided for inducing swirl in the air flowing through said intake duct and throat.

3. The air supply system as in claim 2 wherein said swirl inducing means includes a source of high pressure gas and at least one nozzle positioned about the periphery of said intake duct, said nozzle being connected to said high pressure gas source and oriented tangentially to said intake duct to admit the high pressure gas in the direction of air flow through said intake duct and throat.

4. The air supply system as in claim 3 wherein said fan drive means also generates high pressure combustion gas and constitutes said high pressure gas source.

5. The air supply system as in claim 1 wherein said fan means includes a second set of impeller blades mounted on the inner periphery of said hollow impeller hub for directing said second accelerated air stream through said hub.

6. The air supply system as in claim 1 wherein the conical angles of said joined intake and exhaust ducts are chosen such that substantially straight air flow stream lines can be drawn on the interior surface of one of said intake and exhaust ducts, the extensions of which lines will pass through said throat of said joined ducts without bending and lie along the interior surface of the other duct.

7. The air supply system as in claim 1 wherein a belt is used to operatively interconnect said fan drive means and said impeller hub.

8. The air supply system as in claim 1 further including means for channeling said second accelerated air stream away from said hub, wherein said second stream channeling means includes a tubular duct having a receiving end concentrically overlapping the end of said hub from which said second accelerated air stream exits, a running clearance being provided therebetween.

9. An air supply assembly comprising:

an air acceleration chamber, said chamber including (i) a hollow, open-ended intake duct in the shape of a truncated cone, and (ii) a hollow, open-ended exhaust duct in the shape of a second truncated cone, wherein said intake and exhaust ducts are coaxially aligned along a chamber axis and are joined at their respective truncated conical ends to form a minimum flow area throat;

fan means for generating first and second accelerated air streams in said air acceleration chamber, said fan means including (i) fan drive means, and (ii) a fan impeller mounted in said exhaust duct for rotation about the exhaust duct axis, said fan impeller being operatively connected to be rotatingly driven by said fan drive means, said impeller having a hollow, open-ended hub and a first set of blades mounted on the outer periphery of said hub, said first accelerated air stream flowing between the outer periphery of said hub and said exhaust duct, and said second accelerated air stream flowing through the interior of said hub; and means for inducing swirl in the air flowing through said intake duct, said swirl inducing means including high pressure combustion gas generated by said fan drive means and at least one nozzle positioned about the periphery of said intake duct, said nozzle being connected to said generated high pressure combustion gas and oriented to admit the high pressure gas tangentially into said intake duct.

* * * * *